US005331897A

United States Patent [19]

Handler

[11] Patent Number: 5,331,897

[45] Date of Patent: Jul. 26, 1994

[54] SHIP DECOY

[75] Inventor: George S. Handler, China Lake, Calif.

[73] Assignee: The United States of America as represented by the Secretary of the Navy, Washington, D.C.

[21] Appl. No.: 842,633

[22] Filed: Oct. 7, 1977

Related U.S. Application Data

[63] Continuation-in-part of Ser. No. 603,895, Aug. 7, 1975, abandoned.

[51] Int. Cl.[5] ..... F41H 11/02; F42B 12/46; F42B 30/00

[52] U.S. Cl. ..... 102/341; 89/1.11; 102/356; 102/370; 102/501

[58] Field of Search ..... 102/6, 37.8, 60, 65, 102/66, 87, 90, 501, 502, 505, 341, 370, 356; 89/1 A, 1.11; 431/91; 9/8.3

[56] References Cited

U.S. PATENT DOCUMENTS

| | | | |
|---|---|---|---|
| 650,210 | 5/1900 | Wilson | 441/15 |
| 1,333,313 | 3/1920 | Holmes | 441/15 |
| 1,405,364 | 1/1922 | Von Truppel | 441/11 |
| 1,411,141 | 3/1922 | Vialet-Chabrand | 441/15 |
| 1,445,222 | 2/1923 | Linhardt, Jr. | 441/15 |
| 2,385,376 | 9/1945 | Ogle | 441/15 |
| 2,722,019 | 11/1955 | Brock | 441/26 |
| 2,736,044 | 2/1958 | Lewis | 441/15 |
| 2,894,269 | 7/1959 | Dodge | 441/14 |
| 2,952,309 | 9/1960 | Fay | 89/1.11 |
| 3,453,958 | 7/1969 | Lai | 102/356 |

FOREIGN PATENT DOCUMENTS 411107 5/1934 United Kingdom .

*Primary Examiner*—David H. Brown
*Attorney, Agent, or Firm*—Roy Miller; Melvin J. Sliwka; John L. Forrest, Jr.

[57] ABSTRACT

A decoy device for deployment in a marine environment to decoy heat seeking missiles from their intended target. The device consists of a canister of fuel and means for igniting the fuel. The canister is designed such that the operation of the device creates a spray of burning fuel and a resultant large radiation area decoy.

7 Claims, 1 Drawing Sheet

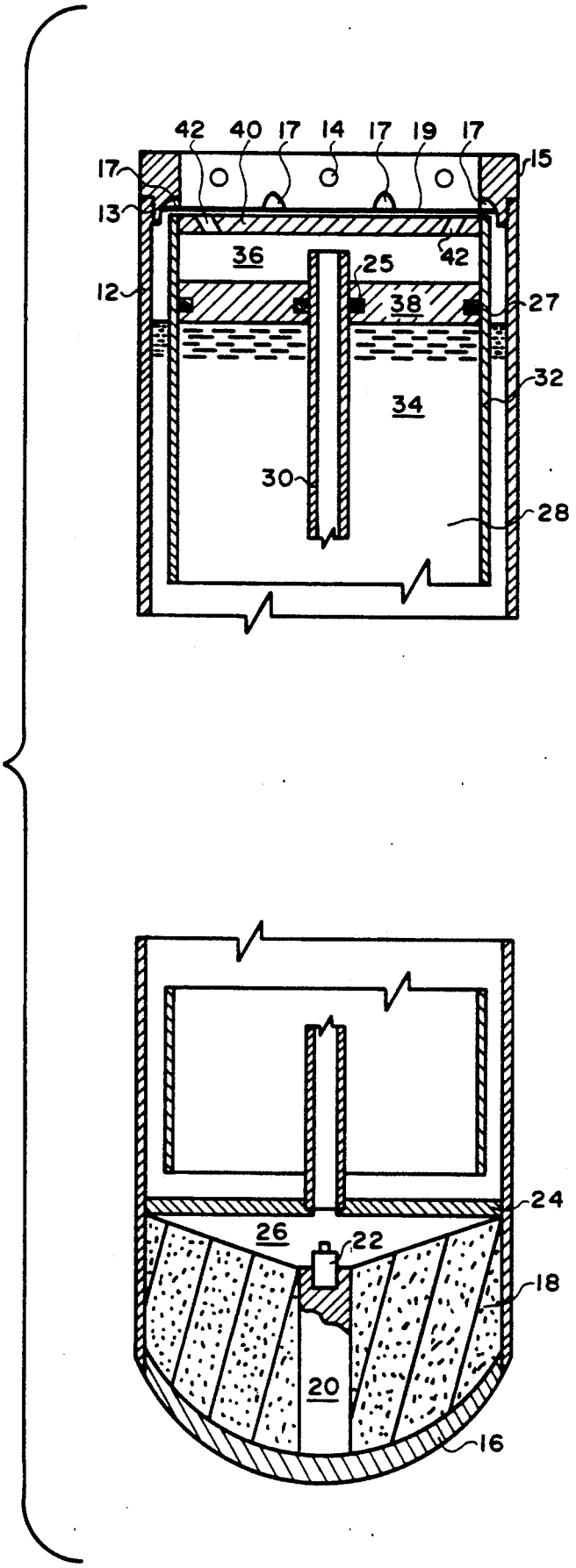
42
40
17
14
17
19
17
15
17
13
36
25
42
12
38
27
32
34
30
28
24
26
22
18
20
16

SHIP DECOY

CROSS REFERENCE TO RELATED APPLICATION

This is a continuation-in-part of U.S. Patent Application Ser. No. 603,895 filed Aug. 7, 1975 by George S. Handler, now abandoned.

BACKGROUND OF THE INVENTION

1. Field of the Invention

This invention relates to a heat producing decoy to protect ships, for example, from enemy infra-red homing missiles. The decoy utilizes inexpensive hydrocarbon or pyrophoric fuel sprayed into the atmosphere above the water. The fuel is ignited by a chemical or energetic ignitor for example, or may be spontaneously ignited on contact with the atmosphere. Examples of energetic ignitors are magnesium/Teflon® and boron/potassium perchlorate. Inexpensive hydrocarbon fuels might be JP-4, JP-5 or diesel oil. Pyrophoric fuels might be trimethel aluminum (TMA) triethyl aluminum or in general, aluminum alkyls. The spray of burning material generates large amounts of infra-red and/or visible radiation which attracts an incoming missile.

2. Description of the Prior Art

Previous ship decoys have utilized small floating sources which were point sources and were readily hidden by waves and swells. Furthermore, most of these devices utilized expensive fluorocarbon fuels. Examples of expensive fluoro carbons are Teflon® (polytetrafluoro ethylene) and Viton-A® (copolymer of vinylidene flouride and hexafluoropropene). As an alternative, in some instances, flame throwers were used which were fixed on the ship and burning fuel was sprayed various distances from the ship. These latter devices were extremely range limited and could only deploy the flame in restricted quadrants about the ship. Furthermore, these fixed devices could not decoy missiles to any appreciable distance from the ship.

SUMMARY OF THE INVENTION

According to the present invention, a decoy is provided which may be ejected from a suitable launcher, may be deployed to practically unrestricted range and direction limited only by size and tactical practicalities. The present device may be fabricated in the form of a cylindrical canister which can be delivered to a desired location from the ship by mortar, rocket, catapult or the like or which may alternatively be hand thrown from the ship or air dropped from an aircraft. It is also contemplated that this device be fuzed such that at any chosen time prior to, at, or after water emersion the ignitor may be initiated or ejection of the fuel material intitiated. The design of the canister is such that the fuel is caused to be expelled upward from the ocean in a spray. The spray pattern is determined by the nozzle design to control the droplet size and hence the burning dwell time and spray pattern to determine the height-to-diameter of the flaming column desired.

BRIEF DESCRIPTION OF THE DRAWING

The single FIGURE of the drawing is a longitudinal cross-sectional view of a decoy device according to the present invention.

DESCRIPTION AND OPERATION

Description

A decoy device generally indicated by the numeral 10 on the drawing comprises an outer metal or plastic cylinder 12. The cylinder 12 is internally threaded at its upper end as at 13 and a cap member 15, externally threaded at its lower end, is secured to the cylinder 12. Cap 15 has holes 14 therein adapted to receive explosive bolts, not shown. The explosive bolts are used to attach a parachute (also not shown) or other retardation device to the cap 15. Cap 15 is also relieved at a number of places about its inner lower circumference to form nozzles, two of which are shown at 17. Also, a burst diaphragm 19 affixed to cap 15 forms a liquid impermeable barrier between the atmosphere and the inner portion of container 12.

The other end of the cylinder 12 is covered and weighted by a weighted hemispheric member 16 to provide a desired center of gravity and center of buoyancy for stability in the water. The lower-most portion of the cylinder 12 contains a gas generator/energetic ignitor grain 18 which is shown provided with a central cavity which contains a fuze device 20 which may comprise a pyrodelay column or acceleration arming device or the like. The fuze shown is equipped with an ignition device such as an electrically operated squib 22.

A liquid impermeable bulkhead 24 is spaced above the upper surface of the grain 18 and forms a combustion chamber 26 therebetween. Bulkhead 24 also separates the combustion chamber from fuel 28 above the bulkhead. The combustion chamber 26 is vented through bulkhead 24 by a vent pipe 30 secured to the bulkhead. Within the cylinder 12 and substantially coextensive therewith, is an inner container 32 divided into two chambers 34, 36 by a free floating piston 38 which is centrally pierced by the pipe 30. Piston 38 carries "O" ring seals 25 and 27 at its inner and outer diameters respectively to ensure a liquid seal between chambers 32 and 36. Chamber 34 is filled with fuel and chamber 36 initially serves as an ullage space for adjustment of buoyancy.

The bottom portion of inner container 32 is open and the top portion is closed by a bulkhead 40. The bulkhead 40 is pierced by a plurality of apertures, two of which are shown at 42, the purpose of which will be explained later.

As shown, container 32 is supported by vent pipe 30 through piston 38 with respect to cylinder 12 in a free-floating relationship. However, container 32 could be fixed with respect to cylinder 12. This could be done by securing the lower skirt of container 32 to bulkhead 24 and drilling holes in the skirt to provide liquid communication between chamber 34 and the space between container 32 and cylinder 12. One might also make container 32 and cylinder 12 from one thick walled member and provide passageways therein to allow liquid flow between chamber 32 and nozzles 17.

Operation

When decoy 10 is deployed, the fuze mechanism 20 is initiated by explosion forces or by electrical pulse to fire squib 22 or both or by reaction with the water, fuze mechanism. After a predetermined time, fuze 20 ignites grain 18 and burning takes place in chamber 26. Combustion gases from chamber 26 pass through pipe 30 and pressurize the ullage space 36. The gases, in turn, pass through apertures 42 and cause the burst diaphragm 19 to rupture and be carried away.

After removal or rupture of the burst diaphragm 19, pressurization of chamber 36 will cause piston 38 to move downwardly thereby causing a flow of fuel down and around container 32 and out of the top of the container 12 through nozzles 17. Some of the hot gases from the burning grain 18 will pass through holes 42 and ignite the fuel if necessary as it flows through nozzles 17. The size and shape of the nozzles 17 may be varied according to the fuel used and the spray desired and the amount of material in grain 18 can be determined by the amount of pressure necessary to empty the fuel from the device.

For best results, the decoy device should start burning immediately after leaving the launch platform or be teamed with a propulsive device such as a rocket or auxiliary radiation source so that a useful radiation level is achieved in minimum time. When the device is deployed by rocket or from a plane, a retardation device may be used such as a parachute or retarding fins to slow the descent of the device into the water. The parachute or retarding fins may be separated from cylinder 12 by means of explosive bolts in-holes 14.

Alternatively, the device may be provided with fins or excess buoyancy means to minimize immersion time in the water. It is to be understood that the buoyancy must be such that the cap end of the decoy remains above water.

When a pyrophoric fuel is used, a cooler or non-burning gas generator material may be used to rupture the burst diaphragm and pressure chamber 36.

A suitable hot gas generator may consist of a magnesium-Teflon® composition and a suitable cool gas generator may be formed of calcium carbide with means provided for ingress of water. Such gas generators are practical because it has been found that only limited pressure is required to obtain the desired mass flow rate of fuel.

Although only one specific form of the invention has been illustrated on the drawing in detail, the invention should not be considered as being thus limited but may include modifications and changes which come within the scope of the appended claims.

What is claimed is:

1. A decoy device adapted for attachment to a delivery device for the protection of ships from enemy infrared homing missiles comprising:

a canister adapted to be delivered to a desired location from a ship;

said canister having means on one end for attachment to the delivery device and a sealed nose closure at the other end;

an initiating device in said canister;

a gas source associated with said initiating device adapted to be initiated thereby;

a fuel chamber in said canister;

a fuel contained in said fuel chamber;

said fuel being a low-cost hydrocarbon;

an inner canister within said fuel chamber having a forward open end and an aft closed end and forming with said first named canister an annular passageway substantially coextensive with said fuel chamber; and means communicating between said gas source and said fuel chamber near the closed end of said inner canister;

whereby, when gases are produced by said gas source and disseminated through said communicating means, pressurization of said fuel chamber will be accomplished and fuel will be forced outwardly between said inner canister and said first named canister in a desired pattern.

2. A decoy device adapted for attachment to a delivery device for the protection of ships from enemy infrared homing missiles comprising;

a canister adapted to be delivered to a desired location from a ship;

said canister having means on one end for attachment to the delivery device and a sealed nose closure at the other end;

an initiating device in said canister;

a gas source associated with said initiating device adapted to be intitiated thereby;

a fuel chamber in said canister;

a fuel contained in said fuel chamber;

an inner canister within said fuel chamber having a forward open end and an aft closed end and forming with said first named canister an annular passageway substantially coextensive with said fuel chamber; and means communicating between said gas source and said fuel chamber near the closed end of said inner canister;

said closed end of said inner canister being pierced by a plurality of peripherally spaced ignition apertures;

whereby, when gases are produced by said gas source and disseminated through said communicating means, pressurization of said fuel chamber will be accomplished and fuel will be forced outwardly between said inner canister in a desired pattern.

3. A decoy device adapted for attachment to a delivery device for the protection of ships from enemy infrared homing missiles comprising;

a canister adapted to be delivered to a desired location from a ship;

said canister having means on one end for attachment to the delivery device and a sealed nose closure at the other end;

an initiating device in said canister;

a gas source associated with said initiating device adapted to be initiated thereby;

a fuel chamber in said canister;

an inner canister within said fuel chamber having a forward open end and an aft closed end and forming with said first named canister an annular passageway substantially coextensive with said fuel chamber;

communicating means between said gas source and said fuel chamber near the closed end of said inner canister;

a piston-like member fitted within said inner canister and having a central opening conforming to said communicating means so that a void chamber is defined between said piston-like member and the closed end of said inner canister;

whereby, when gases are produced by said gas source and disseminated through said communicating means, pressurization of said fuel chamber will be accomplished and fuel will be forced outwardly between said inner canister and said first named canister in a desired pattern.

4. A decoy device adapted for attachment to a delivery device for the protection of ships from enemy infrared homing missiles comprising;

a canister adapted to be delivered to a desired location from a ship;

said canister having means on one end for attachment to the delivery device and a sealed nose closure at the other end;

rupturable closure means covering the end of said canister adapted for attachment to the delivery device;

fuel ejection nozzles spaced peripherally about the inner circumference of said canister;

an initiating device in said canister;

a gas source associated with said initiating device adapted to be initiated thereby;

a fuel chamber in said canister;

a fuel contained in said fuel chamber;

an inner canister within said fuel chamber having a forward open end and an aft closed end and forming with said first named canister an annular passageway substantially coextensive with said fuel chamber; and means communicating between said gas source and said fuel chamber near the closed end of said inner canister;

whereby, when gases are produced by said gas source and disseminated through said communicating means, pressurization of said fuel chamber will be accomplished and fuel will be forced outwardly between said inner canister and said first named canister in a desired pattern.

5. A decoy device as set forth in claim 4 wherein;

said rupturable closure means initially covers said fuel ejection nozzles and is ruptured when pressurization of said fuel chamber is accomplished.

6. A decoy device as set forth in claim 4 wherein; said fuel is a low-cost hydrocarbon.

7. A decoy device as set forth in claim 4 wherein;

said fuel is a pyrophoric fuel such that it is ignitable on contact with the atmosphere.

* * * * *